US011428231B2

(12) United States Patent
Schumnig et al.

(10) Patent No.: US 11,428,231 B2
(45) Date of Patent: Aug. 30, 2022

(54) EXHAUST-GAS TURBOCHARGER

(71) Applicant: BorgWarner Inc., Auburn Hills, MI (US)

(72) Inventors: Oliver Schumnig, Gundersheim (DE); Thomas Duecker-Schulz, Neu-Bamberg (DE); Robert Krewinkel, Kerkrade (NL)

(73) Assignee: BorgWarner Inc., Auburn Hills, MI (US)

( * ) Notice: Subject to any disclaimer, the term of this patent is extended or adjusted under 35 U.S.C. 154(b) by 781 days.

(21) Appl. No.: 14/412,552

(22) PCT Filed: Jul. 3, 2013

(86) PCT No.: PCT/US2013/049221
§ 371 (c)(1),
(2) Date: Jan. 2, 2015

(87) PCT Pub. No.: WO2014/011467
PCT Pub. Date: Jan. 16, 2014

(65) Prior Publication Data

US 2015/0330396 A1 Nov. 19, 2015

(30) Foreign Application Priority Data

Jul. 10, 2012 (DE) ..... 102012013659.5

(51) Int. Cl.

| | |
|---|---|
| ***F04D 25/04*** | (2006.01) |
| ***F04D 17/08*** | (2006.01) |
| ***F04D 29/28*** | (2006.01) |
| ***F01D 25/18*** | (2006.01) |
| ***F01D 25/16*** | (2006.01) |

(52) U.S. Cl.
CPC ..... *F04D 25/045* (2013.01); *F01D 25/16* (2013.01); *F01D 25/183* (2013.01); *F04D 17/08* (2013.01); *F04D 29/284* (2013.01); *F05D 2220/40* (2013.01)

(58) Field of Classification Search
CPC ..... F01D 25/16; F01D 25/183; F04D 17/08; F04D 25/045; F04D 25/183; F04D 29/284; F05D 2220/40
USPC ..... 415/173.5
See application file for complete search history.

(56) References Cited

U.S. PATENT DOCUMENTS 2,818,227 A * 12/1957 Suss ..... F03B 11/006 415/110
3,137,237 A * 6/1964 Zagar ..... F04D 29/146 277/391
4,000,609 A * 1/1977 Chute ..... F02C 3/085 415/186

(Continued)

*Primary Examiner* — Michael L Sehn
(74) *Attorney, Agent, or Firm* — Eric L. Doyle; Stephan A. Pendorf; Patent Central LLC

(57) ABSTRACT

An exhaust-gas turbocharger (1) with a bearing housing (2), a shaft (5) mounted in the bearing housing (2), a turbine wheel (6) which is arranged on the shaft (5), a compressor wheel (7) which is arranged on the shaft (5), and a wheel side space (10) between a rear wall (8) of the turbine wheel (6) or compressor wheel (7) and an outer surface (11), which faces toward the rear wall (8) of the bearing housing (2). In the outer surface (11) of the bearing housing (5), there is formed at least one groove (13, 18) for disrupting the flow generated by the rotating rear wall (8).

7 Claims, 3 Drawing Sheets

(56) References Cited

Figure 1:
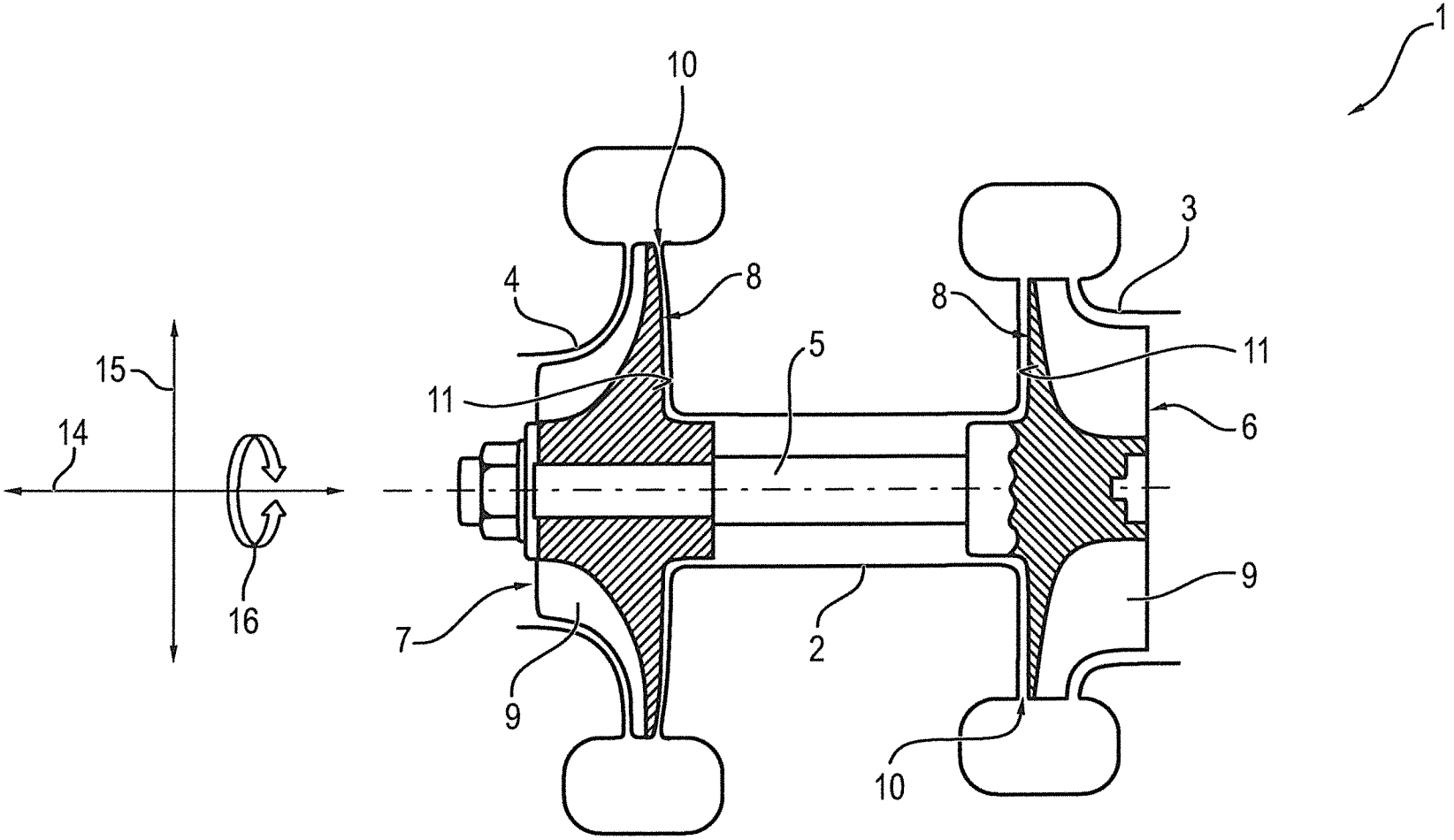

U.S. PATENT DOCUMENTS 4,242,039 A * 12/1980 Villard ..... F04D 29/167
415/112
4,277,222 A * 7/1981 Barbeau ..... F01D 5/046
415/174.5
4,349,322 A * 9/1982 Stable ..... F04D 29/586
415/112
4,648,281 A * 3/1987 Morita ..... G01F 1/10
415/142
4,820,115 A * 4/1989 Bandukwalla ..... F04D 29/668
415/106
5,161,945 A * 11/1992 Clevenger ..... F02C 3/085
415/177
5,489,187 A * 2/1996 Ray ..... B01F 3/04617
415/111
7,384,236 B2 * 6/2008 Meier ..... F01D 25/08
415/178
7,631,497 B2 * 12/2009 Panek ..... F01D 25/186
60/605.1

* cited by examiner

EXHAUST-GAS TURBOCHARGER

The invention relates to an exhaust-gas turbocharger according to the preamble of claim 1.

Conventional exhaust-gas turbochargers have a housing in which a shaft is mounted in a rotationally movable manner. The turbine wheel is seated on one end of the shaft. The compressor wheel is seated on the other end of the shaft. The interior of the bearing housing is normally filled with oil and sealed off with respect to the compressor wheel and the turbine wheel. Essential constituents of the turbine wheel and of the compressor wheel are the blades. In the turbine wheel, the blades are impinged on by the exhaust gas. At the compressor wheel, the blades compress the charge air for the internal combustion engine. On the side facing away from the blades, both the turbine wheel and also the compressor wheel have a rear wall. The rear wall is situated opposite an outer surface of the bearing housing. The gap or the space between said outer wall of the bearing housing and the rear wall of the turbine wheel or of the compressor wheel is normally referred to as the wheel side space. During the rotation of the compressor wheel and of the turbine wheel, a rotating flow is generated in the respective wheel side space, which rotating flow can, in certain operating ranges, lead to a negative pressure in the radially inner region of the wheel side space or at the shaft. Said negative pressure causes oil to be sucked out of the interior of the bearing housing via the seal into the wheel side space. Since air and oil are transported along the flow-conducting components of the compressor and of the turbine into the engine and/or into the exhaust system, said leakage oil leads to considerably impaired emissions values, which must be avoided owing to stringent environmental regulations.

It is an object of the present invention to provide an exhaust-gas turbocharger which, while being inexpensive to produce and assemble, can be operated with the greatest possible efficiency and in as environmentally compatible a manner as possible. In particular, it is sought to prevent the oil leakage from the bearing housing into the wheel side spaces in an effective manner.

The object is achieved by the features of claim 1. The dependent claims relate to preferred refinements of the invention.

According to the invention, grooves are formed on the outer surface, which faces toward the rear wall of the turbine wheel or compressor wheel, of the bearing housing. Said grooves serve for disrupting the flow generated by the rotating rear wall. As a result of said disruption or diversion of the flow, the pressure in the radially inner region of the wheel side space is increased, whereby the leakage from the interior of the bearing housing into the wheel side space is reduced.

The gap between the rear wall of the turbine or compressor wheel and the outer surface of the bearing housing is extremely small in the exhaust-gas turbocharger. So as not to increase the risk of scraping of the rear wall of a wheel against the outer surface of the bearing housing, it is provided according to the invention that no protruding elements are used for disrupting the flow. Instead, only the grooves according to the invention are used.

The grooves are in particular in the form of pockets. That is to say the grooves are not apertures in the wall of the bearing housing but rather are pockets or indentations or recesses.

The individual groove or the multiple grooves in the outer surface may take on a variety of shapes. In one simple embodiment, the groove is formed in a circular manner around the full circumference of the shaft.

In one alternative, it is provided that the groove is of spiral-shaped form. Said spiral shape opens from the inside toward the outside particularly preferably counter to the direction of rotation of the shaft, of the turbine wheel and of the compressor wheel. As a result of said design of the spiral shape, a counter-flow is generated as the rear wall rotates. The flowing gas is thus delivered back into the radially inner region of the wheel side space by the spiral shape.

Furthermore, provision is preferably made for a plurality of radially outwardly extending grooves to be arranged on the outer surface. Said radially outwardly extending grooves are arranged "in the manner of rays" around the shaft. It is provided in particular that the radially outwardly extending grooves run in a curved manner, and may additionally be inclined either in or counter to the flow direction.

In a further embodiment, the grooves are of circular-segment-shaped form. It is thus preferably possible for a plurality of the circular-segment-shaped grooves to be arranged in series along the circumference in order to disrupt the flow in an efficient manner.

The different embodiments of the grooves described above may readily be combined with one another, such that a plurality of different grooves are formed on an outer surface of the bearing housing.

The test has shown that, with the grooves according to the invention, depending on the operating point, a pressure increase of 2.5 to 8% in relation to the conventional arrangements can be obtained in the radially inner region of the wheel side space. This prevents, in an efficient manner, the oil leakage out of the interior of the bearing housing into the wheel side space.

Figure 2:
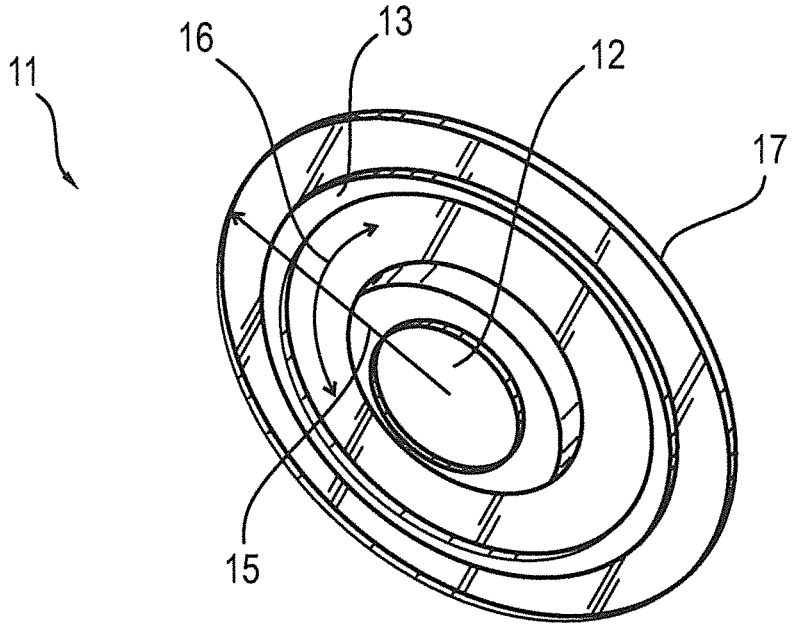
Figure 3:
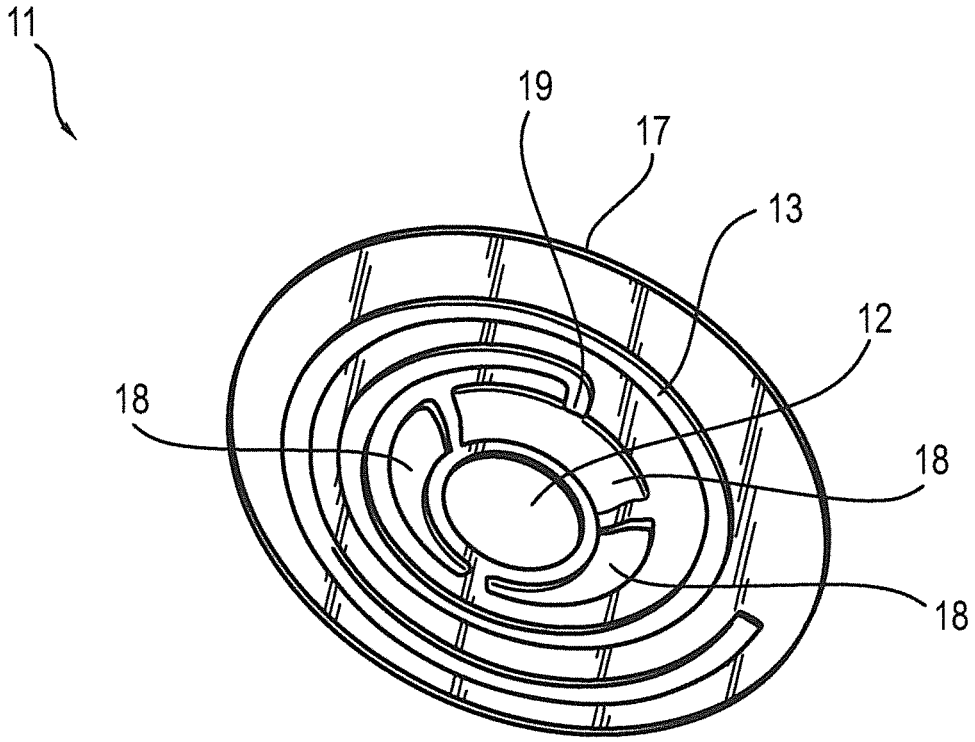
Figure 4:
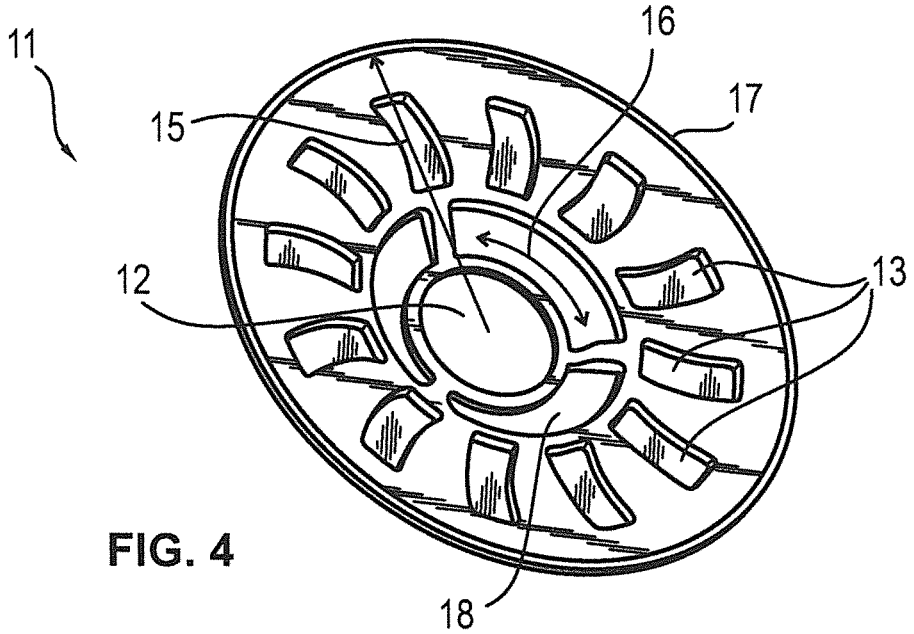
Figure 5:
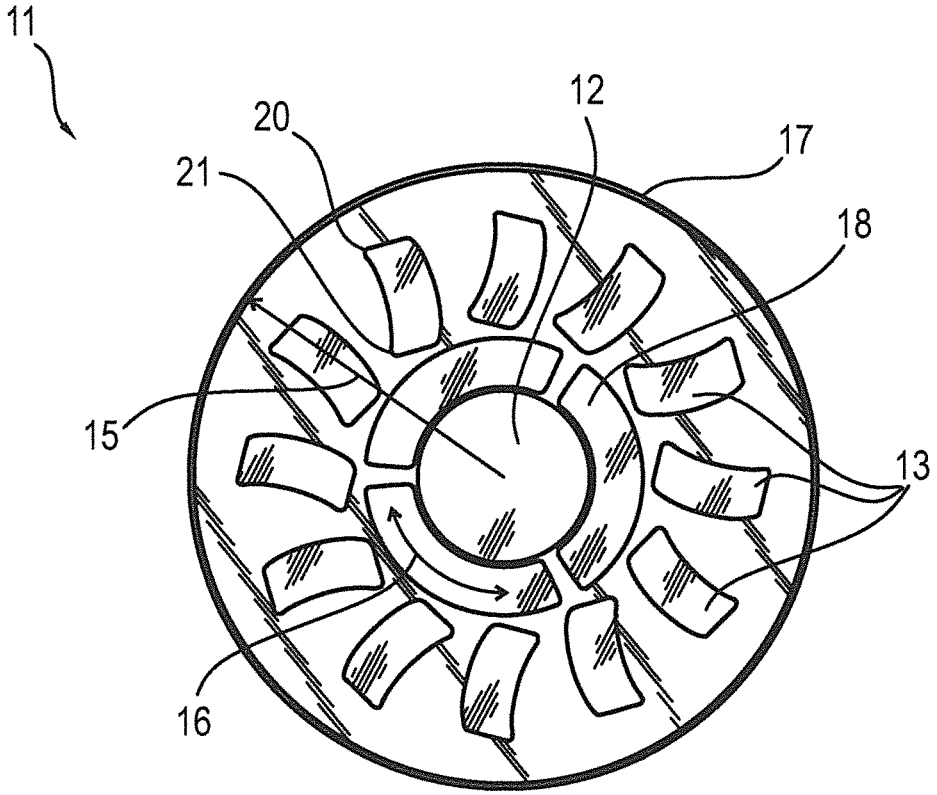

FURTHER DETAILS, ADVANTAGES AND FEATURES OF THE PRESENT INVENTION BECOME APPARENT FROM THE FOLLOWING DESCRIPTION OF EXEMPLARY EMBODIMENTS WITH REFERENCE TO THE DRAWING, IN WHICH:

FIG. 1 shows a schematically simplified view of an exhaust-gas turbocharger according to the invention for all exemplary embodiments, FIG. 2 shows a detail of the exhaust-gas turbocharger according to the invention as per a first exemplary embodiment, FIG. 3 shows a detail of the exhaust-gas turbocharger according to the invention as per a second exemplary embodiment, FIG. 4 shows a detail of the exhaust-gas turbocharger according to the invention as per a third exemplary embodiment, and FIG. 5 shows a detail of the exhaust-gas turbocharger according to the invention as per a fourth exemplary embodiment.

FIG. 1 shows, in a schematically simplified view, the general construction of the exhaust-gas turbocharger 1 for all exemplary embodiments. The exhaust-gas turbocharger 1 comprises a bearing housing 2 in which a shaft 5 is rotatably mounted. A turbine wheel 6 is seated on one end of the shaft 5. A compressor wheel 7 is seated on the other end of the shaft 5. The compressor wheel 7 and the turbine wheel 6 have in each case a rear wall 8 and blades 9. The turbine wheel 6 is impinged on by a flow of exhaust gas. In this way, the turbine wheel 6, the shaft 5 and the compressor wheel 7 are set in rotation. The compressor wheel 7 compresses charge air for an internal combustion engine.

The interior of the bearing housing 2 is filled with oil or an oil/air mixture and is sealed off with respect to the space accommodating the turbine wheel 6 and the compressor wheel 7.

The rear wall 8 of the turbine wheel 6 and of the compressor wheel 7 is in each case situated opposite an outer surface 11 of the bearing housing 2. Between the outer surface 11 and the rear wall 8 there is defined, at both sides, in each case one wheel side space 10.

Furthermore, FIG. 1 shows an axial direction 14 along the shaft 5. A radial direction 15 extends perpendicular to the axial direction 14. A circumferential direction 16 extends around the axial direction 14.

During operation of the exhaust-gas turbocharger 1, the rear walls 8 rotate relative to the outer surfaces 11 in the wheel side space 10. In this way, a rotating flow field is generated in the wheel side space, and a radially outwardly directed gas flow is generated along the wheel rear side. This leads to a decrease in pressure in the wheel side space 10. As a result of the negative pressure gradients, which arise at some operating points of the turbocharger, with respect to the interior of the bearing housing 2, the seal of the shaft 5 with respect to the bearing housing 2 develops leaks, and oil leakage occurs. According to the invention, said oil leakage is prevented to the greatest possible extent.

FIGS. 2 to 5 show four different exemplary embodiments of the design of the outer surface 11, which is situated opposite the rear wall 8, on the side of the turbine wheel 6 and/or of the compressor wheel 7. Identical or functionally identical components are denoted by the same reference numerals in all of the exemplary embodiments.

According to FIG. 2, there is arranged in the outer surface 11 a circular groove 13 which is formed around the full circumference. The turbine wheel 6 or the compressor wheel 7 moves within the edge 17 provided on the outer surface 11.

Furthermore, the outer surface 11 has a shaft recess 12. The shaft 5 extends through said shaft recess 12. In the assembled state, there is situated in said shaft recess 12 a seal for sealing off the interior of the bearing housing 2 with respect to the wheel side space 10.

FIG. 3 shows the outer surface 11 with a groove 13 of spiral-shaped form. In this case, the groove 13 follows a logarithmic spiral. The spiral opens from the inside toward the outside counter to the direction of rotation of the shaft 5. In the example shown, the shaft 5 would thus rotate clockwise. Accordingly, the spiral-shaped groove 13 opens counterclockwise.

FIG. 3 shows three further grooves 18. Said further grooves 18 are in each case of circular-segment-shaped form. The three circular-segment-shaped grooves 18 are arranged in series in the circumferential direction 16. The inner end of the groove 13 leads via a mouth 19 into one of the further grooves 18. It is the object of the inner grooves to decelerate the flow and thus increase the static pressure without disrupting the flow field.

FIG. 4 shows the outer surface 11 with a plurality of (twelve in the example) radially outwardly extending grooves 13. The grooves 13 extend in the radial direction 15. This means that said grooves extend further in the radial direction 15 than in the circumferential direction 16. The circular-segment-shaped further grooves 18 already shown in FIG. 3 are additionally provided in FIG. 4.

The grooves 13 in FIG. 4 are of curved form. This means that each individual groove is curved in the circumferential direction 16.

FIG. 5 likewise shows an outer surface 11 having 12 radially outwardly extending grooves 13 and three circular-segment-shaped further grooves 18. By contrast to FIG. 4, the grooves 13 in FIG. 5 are both curved in the radial direction and also inclined in the circumferential direction 16. Said inclination means that a first point 20 and a second point 21 on an outer edge of the groove 13 do not lie on a straight line through the central point of the shaft 5.

The embodiments of the groove 13 and further grooves 18 shown in FIGS. 2, 4 and 5 serve primarily for disrupting the radially outwardly directed flow in the wheel side space 10. By means of the spiral-shaped groove 13 in FIG. 3, the flow is diverted such that a mass flow leads via the spiral-shaped groove 13 to the radially inner region of the wheel side space 10. The number, position, depth and shape of the grooves can preferably be optimized by means of CFD calculation and test procedures for the respective application.

In addition to the above written description of the invention, reference is hereby explicitly made to the diagrammatic illustration of the invention in FIGS. 1 to 5 for additional disclosure thereof.

LIST OF REFERENCE SIGNS

1 Exhaust-gas turbocharger
2 Bearing housing
3 Turbine housing
4 Compressor housing
5 Shaft
6 Turbine wheel
7 Compressor wheel
7 Rear wall
9 Blades
10 Wheel side space
11 Outer surface
12 Shaft recess
13 Groove
14 Axial direction
15 Radial direction
16 Circumferential direction
17 Edge
18 Further grooves (circular-segment-shaped)
19 Mouth
20 First point
21 Second point

The invention claimed is:

1. An exhaust-gas turbocharger (1) comprising:

a bearing housing (2), a shaft (5) mounted in the bearing housing (2) for rotating in a shaft direction of rotation, a turbine wheel (6) which is arranged on the shaft (5), said turbine wheel having a rear wall facing the bearing housing (2), and a compressor wheel (7) which is arranged on the shaft (5), said compressor wheel having a rear wall facing the bearing housing (2), wherein an air space (10) is formed between the rear wall (8) of the turbine wheel (6) or compressor wheel (7) and a bearing housing outer surface (11), which bearing housing outer surface (11) faces toward the rear wall (8) of the turbine wheel (6) or compressor wheel (7), wherein rotation of the rear wall (8) in the shaft direction of rotation generates a rotating flow of air in the air space (10) in the direction of rotation and also radially outwards producing a negative static pressure in the radially inner region of the air space (10), wherein in the bearing housing outer surface (11), there is formed at least one groove (13, 18), wherein said at least one groove (13, 18) is spiral-shaped opening radially outwardly counter to the shaft direction of rotation, or is a plurality of circular-segment-shaped grooves (18) opening radially outwardly counter to the shaft direction of rotation, wherein said at least one groove (13, 18) is dimensioned in cooperation with said rear wall (8) that upon rotation of said shaft (5) in the shaft direction of rotation said at least one groove (13, 18) decelerates the flow of air in the direction of rotation and also radially outwards and thus increases the static pressure in the radially inner region of the wheel space (10) from a more negative to a less negative static pressure.

2. The exhaust-gas turbocharger as claimed in claim 1, wherein the at least one groove (13, 18) is in the form of a pocket.

3. The exhaust-gas turbocharger as claimed in claim 1, wherein the at least one groove (13) is formed around the full circumference of the shaft.

4. The exhaust-gas turbocharger as claimed in claim 1, wherein said at least one groove (13, 18) is a plurality of radially outwardly extending grooves (13).

5. The exhaust-gas turbocharger as claimed in claim 4, wherein the radially outwardly extending grooves (13) run in a curved manner.

6. The exhaust-gas turbocharger as claimed in claim 1, wherein the shaft (5) extends through the outer surface (11) of the bearing housing (2), and wherein a seal is arranged between the shaft (5) and the outer surface (11).

7. A method for preventing oil leakage from the bearing housing of an exhaust gas turbocharger, wherein the exhaust-gas turbocharger (1) comprises:

a bearing housing (2), a shaft (5) mounted in the bearing housing (2) for rotating in a shaft direction of rotation, a turbine wheel (6) which is arranged on the shaft (5), said turbine wheel having a rear wall facing the bearing housing (2), and a compressor wheel (7) which is arranged on the shaft (5), said compressor wheel having a rear wall facing the bearing housing (2), wherein an air space (10) is formed between the rear wall (8) of the turbine wheel (6) or compressor wheel (7) and a bearing housing outer surface (11), which bearing housing outer surface (11) faces toward the rear wall (8) of the turbine wheel (6) or compressor wheel (7), and the method comprising:

forming in the bearing housing outer surface (11) at least one groove (13, 18), wherein said at least one groove (13, 18) is spiral-shaped opening radially outwardly counter to the shaft direction of rotation, or is a plurality of circular-segment-shaped grooves (18) opening radially outwardly counter to the shaft direction of rotation, rotating the rear wall (8) in the shaft direction of rotation to generate a rotating flow of air in the air space (10) in the direction of rotation and also radially outwards, producing a negative static pressure in the radially inner region of the air space (10), wherein said at least one groove (13, 18) is dimensioned in cooperation with said rear wall (8) that upon rotation of said shaft (5) in the shaft direction of rotation said at least one groove (13, 18) decelerates the flow of air in the direction of rotation and also radially outwards and thus increases the static pressure in the radially inner region of the wheel space (10) to a less negative static pressure.

* * * * *